US011031192B2

(12) United States Patent
Kubota et al.

(10) Patent No.: US 11,031,192 B2
(45) **Date of Patent: *Jun. 8, 2021**

(54) SWITCHGEAR

(71) Applicant: Mitsubishi Electric Corporation, Tokyo (JP)

(72) Inventors: Masato Kubota, Tokyo (JP); Katsushi Nakada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/636,196

(22) PCT Filed: Sep. 28, 2017

(86) PCT No.: PCT/JP2017/035276
§ 371 (c)(1),
(2) Date: Feb. 3, 2020

(87) PCT Pub. No.: WO2019/064446
PCT Pub. Date: Apr. 4, 2019

(65) Prior Publication Data

US 2020/0373100 A1 Nov. 26, 2020

(51) Int. Cl.
*H01H 5/08* (2006.01)

(52) U.S. Cl.
CPC ..... *H01H 5/08* (2013.01)

(58) Field of Classification Search
CPC .. H01H 5/08; H01H 5/02; H01H 5/10; H01H 31/02; H01H 31/32; H01H 33/40; H01H 33/42; H01H 31/003
(Continued)

(56) References Cited

U.S. PATENT DOCUMENTS 3,987,260 A * 10/1976 Wilson ..... H02B 13/075 218/79
4,296,288 A * 10/1981 Yanabu ..... H01H 33/12 218/12
(Continued)

FOREIGN PATENT DOCUMENTS

DE 1118315 * 11/1961 ..... H01H 36/00
JP S5599045 U 7/1980
(Continued)

OTHER PUBLICATIONS

Translation DE1118315 (Original document published Nov. 30, 1961) (Year: 1961).*
(Continued)

*Primary Examiner* — William A Bolton
(74) *Attorney, Agent, or Firm* — Buchanan Ingersoll & Rooney PC

(57) ABSTRACT

A switchgear includes a movable part capable of reciprocating movement in first and second directions, a movable contact coupled to the movable part and capable of reciprocating movement relative to the movable part, a biasing member that biases the movable contact, a latch part capable of switching between a first state in which movement of the movable contact in the first direction is restricted and a second state in which movement of the movable contact in the first direction is permitted, and a fixed contact provided on a side of the first direction with respect to the movable contact. When the movable part and the movable contact move in the first direction, after movement for a predetermined distance, the movement of the movable contact is restricted by the latch part in the first state, and then, when the movable part has moved further in the first direction, the latch part is switched to the second state.

4 Claims, 6 Drawing Sheets

(58) Field of Classification Search
USPC ..... 218/100, 12–14, 16, 23, 45, 55, 56, 67, 218/79, 80, 97
See application file for complete search history.

(56) References Cited

U.S. PATENT DOCUMENTS

| | | | | |
|---|---|---|---|---|
| 4,413,166 | A * | 11/1983 | Meyer | H02B 13/075 218/80 |
| 5,237,137 | A * | 8/1993 | Lorenz | H01H 33/122 218/14 |
| 7,919,720 | B2 * | 4/2011 | Shimizu | H01H 33/90 218/62 |
| 2006/0243703 | A1 * | 11/2006 | Meinherz | H02B 5/06 218/134 |
| 2009/0166168 | A1 | 7/2009 | Nakauchi et al. | |
| 2014/0346147 | A1 | 11/2014 | Blanchet et al. | |

FOREIGN PATENT DOCUMENTS

| | | | |
|---|---|---|---|
| JP | S55175942 | U | 12/1980 |
| JP | H07249356 | A | 9/1995 |
| JP | 2009163946 | A | 7/2009 |
| JP | 2010027479 | A | 2/2010 |
| JP | 2015505130 | A | 2/2015 |

OTHER PUBLICATIONS

Extended European Search Report dated Jul. 16, 2020 for corresponding European patent application No. 17926393.4, 6 pages.
International Search Report (PCT/ISA/210) dated Dec. 19, 2017, by the Japan Patent Office as the International Searching Authority for International Application No. PCT/JP2017/035276.
Written Opinion (PCT/ISA/237) dated Dec. 19, 2017, by the Japan Patent Office as the International Searching Authority for International Application No. PCT/JP2017/035276.

* cited by examiner

SWITCHGEAR

FIELD

The present invention relates to a switchgear that includes a fixed contact and a movable contact.

BACKGROUND

In a switchgear, a circuit is connected and disconnected by contact and separation between a fixed contact and a movable contact. Examples of switchgears include a grounding switch used for grounding a main circuit when checking equipment. As described in Patent Literature 1, for grounding a main circuit, a movable contact on the grounding side is moved to be brought into contact with a fixed contact on the main circuit side. For bringing the movable contact into contact with the fixed contact, the main circuit is disconnected in advance in a state in which no voltage is applied to the fixed contact.

CITATION LIST

Patent Literature

Patent Literature 1: Japanese Patent Application Laid-open No. 2009-163946

SUMMARY

Technical Problem

Some of such switchgears are required to be reliable in that connection is safely achieved even in a case where the movable contact is erroneously brought into contact with the fixed contact in a state in which the main circuit is closed without being disconnected. In order to achieve the reliability, the duration of an arc occurring between the movable contact and the fixed contact needs to be shortened. Thus, the movable contact is moved at high speed in an attempt to shorten the time from formation of an arc until the movable contact comes in contact with the fixed contact. In order to move the movable contact at high speed, an operating device that generates a large driving force is needed. The increase in the size of the operating device is therefore a problem.

The present invention has been made in view of the above, and an object thereof is to provide a switchgear capable of shortening the duration of an arc while reducing the size of an operating device.

Solution to Problem

To solve the aforementioned problems an achieve the object, the present invention includes a movable part capable of reciprocating movement including movement in a first direction and movement in a second direction opposite to the first direction, a movable contact coupled to the movable part on a side of the first direction and capable of reciprocating movement toward the first direction and the second direction relative to the movable part, a biasing member that biases the movable contact in the first direction relative to the movable part, a latch part capable of switching between a first state in which movement of the movable contact in the first direction is restricted and a second state in which movement of the movable contact in the first direction is permitted, and a fixed contact provided on a side of the first direction with respect to the movable contact. The movable part and the movable contact move in the first direction from initial positions at which the movable contact is away from the fixed contact to closed positions at which the movable contact is in contact with the fixed contact, In a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the biasing member after the movement of the movable contact was restricted, the latch part is switched to the second state in which the movement of the movable contact in the first direction is permitted.

Advantageous Effects of Invention

A switchgear according to the present invention provides an effect of shortening the duration of an arc while reducing the size of an operating device.

DESCRIPTION OF EMBODIMENTS

A switchgear according to certain embodiments of the present invention will be described in detail below with reference to the drawings. Note that the present invention is not limited to the embodiments.

First Embodiment

Figure 1:
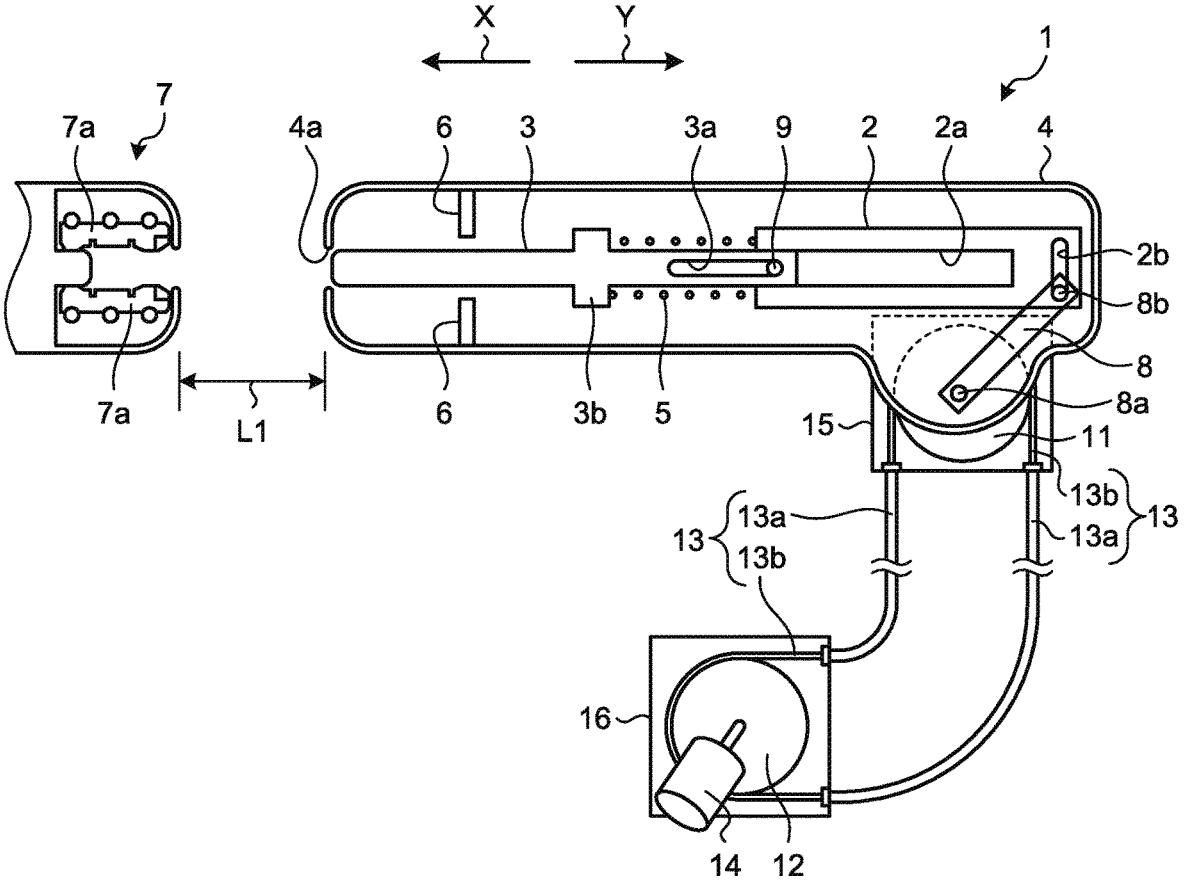
FIG. 1 is a cross-sectional view illustrating a schematic configuration of a switchgear according to a first embodiment of the present invention.
Figure 2:
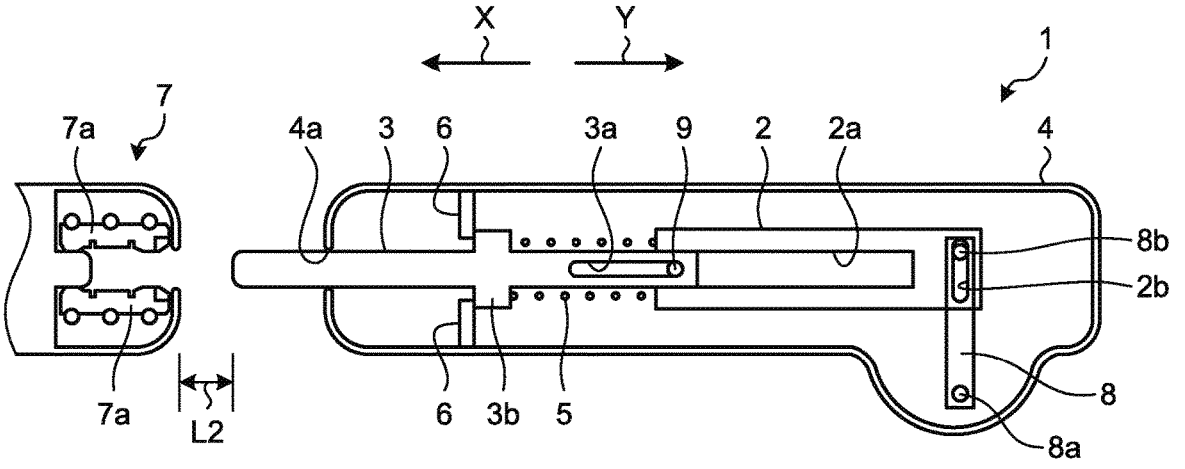
FIG. 2 is a cross-sectional view explaining closing operation in the switchgear according to the first embodiment.
Figure 3:
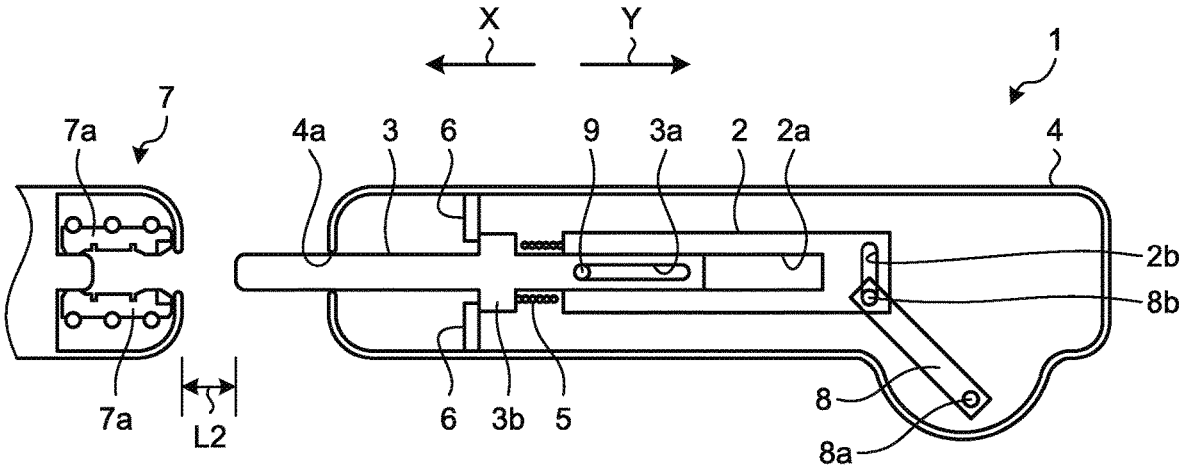
FIG. 3 is a cross-sectional view explaining the closing operation in the switchgear according to the first embodiment.
Figure 4:
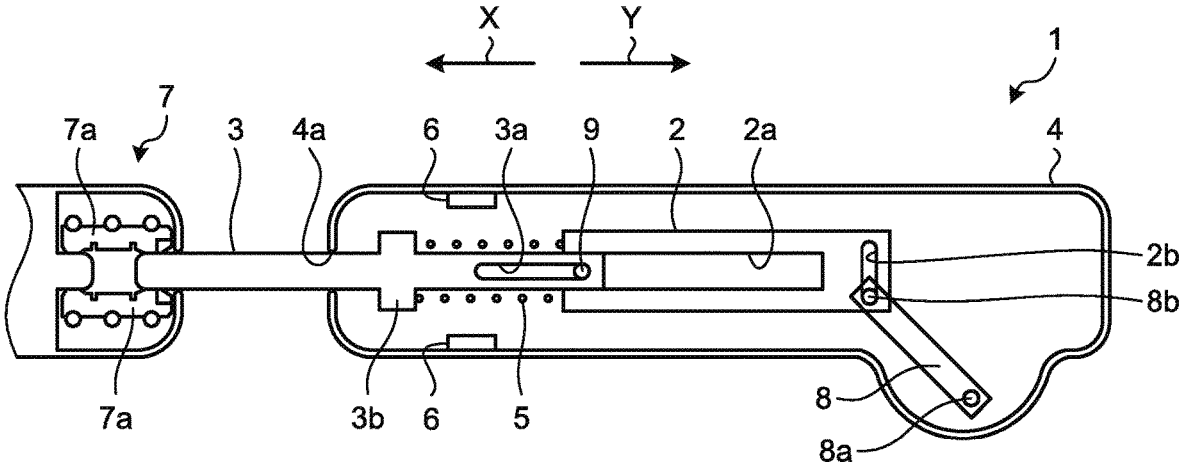
FIG. 4 is a cross-sectional view explaining the closing operation in the switchgear according to the first embodiment.
Figure 5:
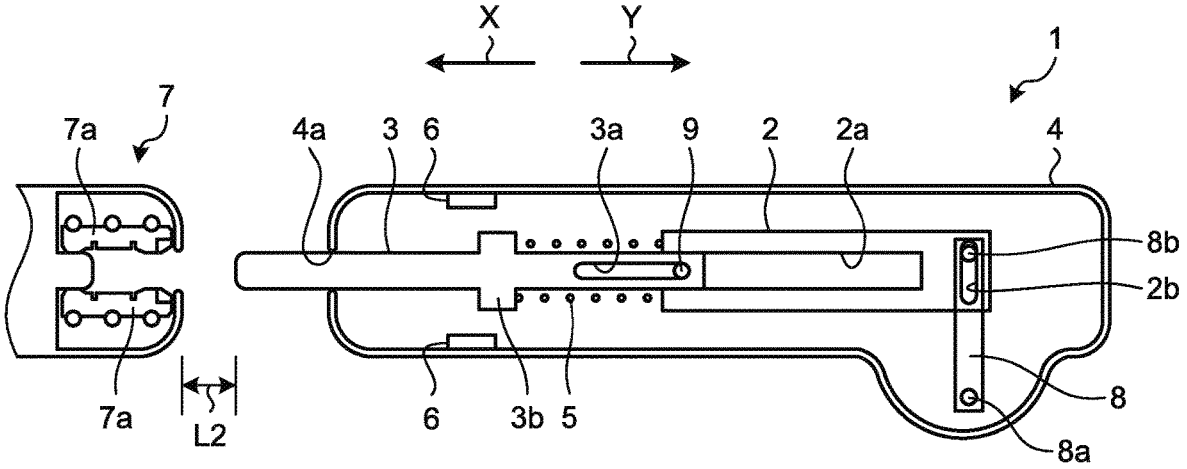
FIG. 5 is a cross-sectional view explaining opening operation in the switchgear according to the first embodiment.
Figure 6:
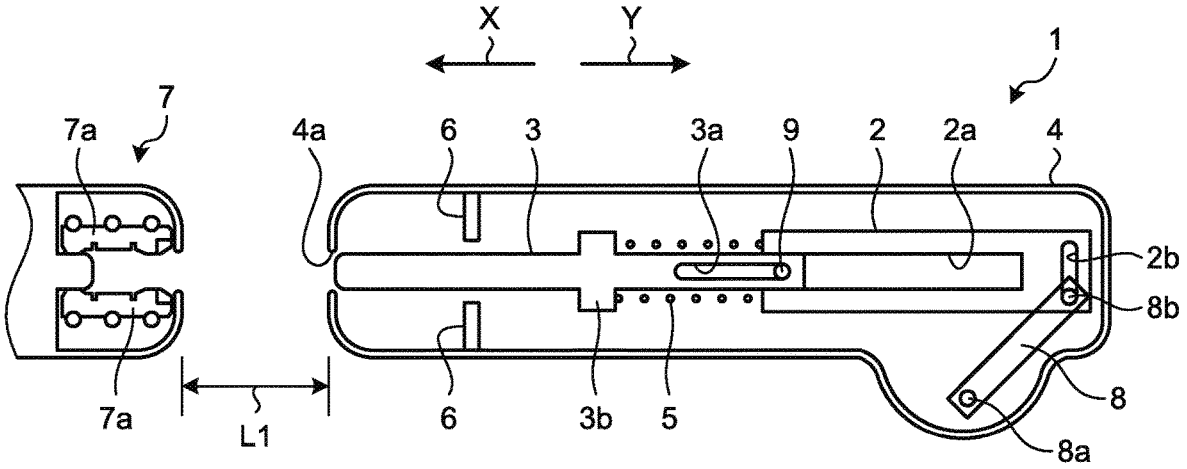
FIG. 6 is a cross-sectional view explaining the opening operation in the switchgear according to the first embodiment.

FIG. 1 is a cross-sectional view illustrating a schematic configuration of a switchgear according to a first embodiment of the present invention. FIGS. 2 to 4 are cross-sectional views explaining closing operation in the switchgear according to the first embodiment. FIGS. 5 and 6 are cross-sectional views explaining opening operation in the switchgear according to the first embodiment. A switchgear 1, which is a grounding switch, is used in a tank (illustration is omitted) in which insulating gas having electrically insulating and arc-extinguishing properties, such as sulfur hexafluoride ($SF_6$) gas is enclosed. The switchgear 1 includes a movable part 2, a movable contact 3, a spring 5, a frame 4, a latch part 60, a fixed contact 7, a lever 8, and a motor 14.

The movable part 2 is capable of reciprocating movement toward a direction indicated by an arrow X, which is a first direction, and toward a direction indicated by an arrow Y, which is a second direction opposite to the first direction. The movable part 2 has a hole 2*a* extending from an end thereof on the side of the direction indicated by the arrow X toward the direction indicated by the arrow Y. A pin 9 is provided inside the hole 2*a* of the movable part 2. A groove 2*b* extending in a direction perpendicular to the moving direction of the movable part 2 is formed on the movable part 2.

The movable contact 3 is located on the side of the direction indicated by the arrow X with respect to the movable part 2 and coupled to movable part 2. More specifically, an end of the movable contact 3 on the side of the direction indicated by the arrow Y is inserted in the hole 2*a* of the movable part 2. Because the movable contact 3 is inserted in the hole 2*a*, the movable contact 3 is capable of reciprocating movement relative to the movable part 2 toward the direction indicated by the arrow X and toward the direction indicated by the arrow Y.

A groove 3*a* extending along the moving direction of the movable contact 3 is formed at an end on the side of the direction indicated by the arrow Y of the movable contact 3. The pin 9 provided inside the hole 2*a* of the movable part 2 is inserted in the groove 3*a*. The pin 9 is caught by an end of the groove 3*a*, which prevents the movable contact 3 from moving excessively in the direction indicated by the arrow X and falling off from the hole 2*a*. The movable contact 3 has a projecting portion 3*b* projecting in a direction perpendicular to the moving direction. Note that, in the following description, part of the movable contact 3 on the side of the direction indicated by the arrow X with respect to the projecting portion 3*b* will be referred to as a distal part, and part of the movable contact 3 on the side of the direction indicated by the arrow Y with respect to the projecting portion 3*b* will be referred to as a base part. Thus, the groove 3*a* mentioned above is formed on the base part of the movable contact 3. In addition, the distal part of the movable contact 3 serves as a contact brought in contact with the fixed contact 7 as the movable contact 3 moves in the direction indicated by the arrow X.

The spring 5 is a helical compression spring provided between an end face of the movable part 2 on the side of the direction indicated by the arrow X and the projecting portion 3*b* of the movable contact 3. The spring 5 is a biasing member that biases the movable contact 3 in the direction indicated by the arrow X relative to the movable part 2. As described above, even when the movable contact 3 is moved in the direction indicated by the arrow X by the biasing force of the spring 5, the pin 9 is caught by the end of the groove 3*a* of the movable contact 3, and thus the movable contact 3 does not fall off from the hole 2*a* of the movable part 2.

The frame 4 is an accommodating part that accommodates the movable part 2 and the movable contact 3 therein. The frame 4 has an opening 4*a* through which the distal part of the movable contact 3 can pass. The distal part of the movable contact 3 protrudes outside of the frame 4 through the opening 4*a* as the movable contact 3 moves in the direction indicated by the arrow X.

The latch part 6 is fixed to the inside of the frame 4. As illustrated in FIG. 1, the latch part 6 is located on the side of the direction indicated by the arrow X with respect to the projecting portion 3*b* of the movable contact 3 in a state in which the movable part 2 and the movable contact 3 are at positions after having moved in the direction indicated by the arrow Y. Note that the positions of the movable part 2 and the movable contact 3 in a state in which the movable contact 3 is away from the fixed contact 7 as illustrated in FIG. 1 will be referred to as initial positions.

The latch part 6 has an opening that allows passage of the distal part of the movable contact 3 but does not allow passage of the projecting portion 3*b* of the movable contact 3. The latch part 6 is constituted by a plurality of members, and the opening is formed by a gap between the members. Alternatively, the latch part 6 may be constituted by an annular member having an opening, which constitutes the aforementioned opening, at the center.

As illustrated in FIG. 2, as the movable contact 3 moves from the initial positions in the direction indicated by the arrow X, the projecting portion 3*b* of the movable contact 3 comes into contact with the latch part 6, which restricts further movement of the movable contact 3 in the direction indicated by the arrow X. A state of the latch part 6 capable of restricting the movement of the movable contact 3 in the direction indicated by the arrow X movable contact 3 in this manner will be referred to as a first state. At the initial positions, however, the projecting portion 3*b* is not in contact with the latch part 6, and the movement of the movable contact 3 is not restricted although the latch part 6 is in the first state.

The latch part 6 is switchable to a second state in which the movement of the movable contact 3 in the direction indicated by the arrow X is permitted. As illustrated in FIG. 4, when the latch part 6 falls and changes its posture, the contact between the latch part 6 and the projecting portion 3*b* is released. The release of the contact between the latch part 6 and the projecting portion 3*b* allows the movement of the movable contact 3 in the direction indicated by the arrow X.

The lever 8 is a rod-like member located inside the frame 4 and being rotatable about a shaft 8*a*. The lever 8 includes a pin 8*b* inserted in the groove 2*b* of the movable part 2. As the lever 8 turns with the pin 8*b* being inserted in the groove 2*b*, the movable part 2 moves linearly in the direction indicated by the arrow X or the direction indicated by the arrow Y.

A first pulley 11 is coupled to the shaft 8*a*. The lever 8 turns with the first pulley 11. The first pulley 11 is supported by a first base 15. A second pulley 12 is provided at a position away from the first pulley 11. The second pulley 12 is turned by the motor 14. The second pulley 12 is supported by a second base 16. Two flexible jackets 13*a* are provided between the first base 15 and the second base 16. The flexible jackets 13*a* have flexibility and a cylindrical shape in which wires 13*b* are inserted. A flexible jacket 13*a* and a wire 13*b* constitute a wire mechanism 13. Each of the flexible jackets 13*a* has one end fixed to the first base 15 and the other end fixed to the second base 16. The wires 13*b* inserted in the flexible jackets 13*a* are slidable along the extending direction of the flexible jackets 13*a*. In addition, the wires 13*b* have a loop shape and are looped around the first pulley 11 and the second pulley 12. As the second pulley 12 turns, the wires 13*b* slide, which causes the first pulley 11 to turn with the turning of the second pulley 12. Thus, as the second pulley 12 is turned by the motor 14, the first pulley 11 and the lever 8, and the movable part 2 moves. In this manner, the motor 14 functions as a driver that moves the movable part 2. In an operating device, the wires 13*b* are slidable along the shapes of the flexible jackets 13*a* between the first pulley 11 and the second pulley 12. Thus, even in a case where the shapes of the flexible jackets 13*a* are changed, the first pulley 11 can be turned with the turning of the second pulley 12. Thus, the shapes of the flexible jackets 13*a* can be changed, so that the second pulley 12 and the motor 14 can be installed at various positions.

The fixed contact 7 is located on the side of the direction indicated by the arrow X with respect to the movable contact 3. The fixed contact 7 has a plurality of contact points 7*a*. As illustrated in FIG. 4, when the distal part of the movable contact 3 is inserted between the contact points 7*a*, the fixed contact 7 and the movable contact 3 come into contact with each other. In a case where the switchgear 1 is a grounding switch in which the fixed contact 7 is on the main circuit side and the movable contact 3 is on the grounding side, the main circuit is grounded when the fixed contact 7 and the movable contact 3 are in contact with each other. As illustrated in FIG. 4, the positions of the movable part 2 and the movable contact 3 in a state in which the movable contact 3 is in contact with the fixed contact 7 will be referred to as closed positions.

Next, closing operation in which the movable part 2 and the movable contact 3 move from the initial positions to the closed positions will be explained. As the movable part 2 and the movable contact 3 move a predetermined distance from the initial positions illustrated in FIG. 1 in the direction indicated by the arrow X as illustrated in FIG. 2, the projecting portion 3*b* of the movable contact 3 comes into contact with the latch part 6, which restricts further movement of the movable contact 3 in the direction indicated by the arrow X.

Subsequently, as illustrated FIG. 3, as the movable part 2 moves further in the direction indicated by the arrow X against the biasing force of the spring 5 in the state in which the movement of the movable contact 3 in the direction indicated by the arrow X is restricted, the spring 5 is compressed and the force thereof is accumulated. When a sufficient force is accumulated in the spring 5, the latch part 6 falls to be switched to the second state as illustrated in FIG. 4, in which the movement of the movable contact 3 in the direction indicated by the arrow X is thus permitted, the force accumulated in the spring 5 is released, and the movable contact 3 moves in the direction indicated by the arrow X at a speed higher than the moving speed of the movable part 2 before the release. The distal part of the movable contact 3 is then inserted between the contact points 7*a*, the movable contact 3 and the fixed contact 7 come into contact with each other, and the closing operation is thus completed. At this point, the movable part 2 and the movable contact 3 are at the closed positions.

Next, opening operation in which the movable part 2 and the movable contact 3 move from the closed positions to the initial positions will be explained. As illustrated in FIG. 5, as the movable part 2 moves in the direction indicated by the arrow Y, the movable contact 3 is caught by the pin 9 and thus also moves in the direction indicated by the arrow Y. As a result, the movable contact 3 is separated from the fixed contact 7.

As the movable part 2 and the movable contact 3 move further in the direction indicated by the arrow Y, the movable part 2 and the movable contact 3 return to the initial positions as illustrated in FIG. 6. Furthermore, the latch part 6 is switched to the first state, and the opening operation is thus completed.

In the switchgear 1 having the configuration as described above, the movable part 2 and the movable contact 3 do not move at high speeds until the movement of the movable contact 3 becomes restricted and the force is accumulated in the spring 5 as illustrated in FIG. 3. Subsequently, as illustrated in FIG. 4, when the latch part 6 is switched to the second state, the movable contact 3 moves at high speeds.

The distance L1 between the movable contact 3 and the fixed contact 7 at the initial positions is set to such a distance with which an arc is less likely to occur between the movable contact 3 and the fixed contact 7 even when an abnormal voltage exceeding a steady state is applied to a main circuit connected with the fixed contact 7, such as when the main circuit is hit by lightning, for example. In addition, the distance L2 between the movable contact 3 and the fixed contact 7 in the state in which the movement is restricted by the latch part 6, that is, in the state illustrated in FIGS. 2 and 3 is set to such a distance with which no arc occurs when a steady state voltage is applied to a main circuit connected with the fixed contact 7 and which is shorter than the distance L1.

Thus, in a process of moving the movable contact 3 from the initial position to a position where the distance to the fixed contact 7 is L2 and thereafter accumulating the force in the spring 5, no arc will occur in a state in which the a steady state voltage is applied to the main circuit, and the movable part 2 and the movable contact 3 may therefore be moved at low speeds. This enables the driving force for moving the movable part 2 to be reduced. As a result, the operating device for moving the movable part 2 can be constituted by the first pulley 11, the second pulley 12, the wire mechanisms 13, and the motor 14, which enables reduction in size as compared to an operating device in which the motor 14 and the lever 8 are connected by a rigid member therebetween. In addition, the lengths of the flexible jackets 13*a* and the wires 13*b* can be changed and the shapes of the flexible jackets 13*a* can be changed, which enables the second pulley 12 and the motor 14 to be placed at various positions. As a result, the second pulleys 12 and the motors 14 of a plurality of operating devices can be placed together, which improves the maintenance efficiency. Note that looping of a plurality of wires 13*b* around the second pulley 12 enables turning of a plurality of first pulleys 11 by one motor 14, that is, movement of a plurality of movable parts 2 and movable contacts 3 by one motor 14, which further improves the maintenance efficiency and reduces the size of the operating device. Note that, in FIGS. 2 to 6, the operating device is not illustrated.

In addition, in a range in which the distance between the movable contact 3 and the fixed contact 7 is shorter than L2, that is, in a range in which an arc may occur, the movable contact 3 can be moved at high speeds with se of the force accumulated in the spring 5. Thus, in the range in which an arc may occur, the movable contact 3 is moved at high speeds so that the movable contact 3 is brought into contact with the fixed contact 7 in a shorter time, which shortens the duration of an arc.

As described above, in the switchgear 1, the movable contact 3 is moved at high speeds only in the range in which arc may occur in the state in which a steady state voltage is applied to the main circuit, less energy is required of the operating device than a case where the movable contact 3 is moved at high speeds in all ranges from the initial positions to the closed positions. Thus, use of the pulleys and the like as described above enables reduction in the size of the operating device.

Note that the switching of the latch part 6 from the first state to the second state and the switching thereof from the second state to the first state, that is, the change in the posture of the latch part 6 may be carried out on the basis of an electrical signal transmitted on the basis of the position of the movable part 2 or the angle of rotation of the motor 14, or may be carried out by a mechanical operation on the basis of the position of the movable part 2 or the like.

Second Embodiment

Figure 7:
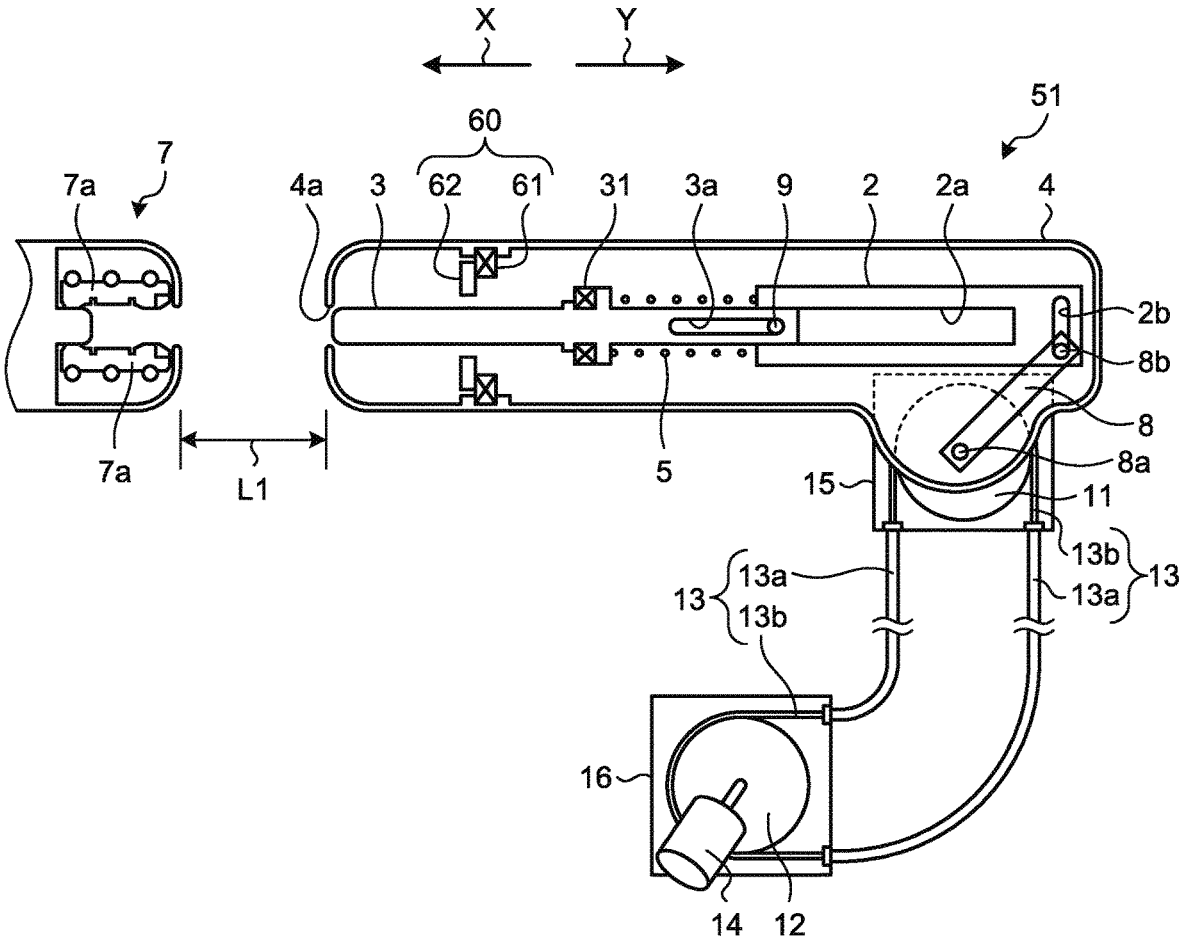
FIG. 7 is a cross-sectional view illustrating a schematic configuration of a switchgear according to a second embodiment of the present invention.
Figure 8:
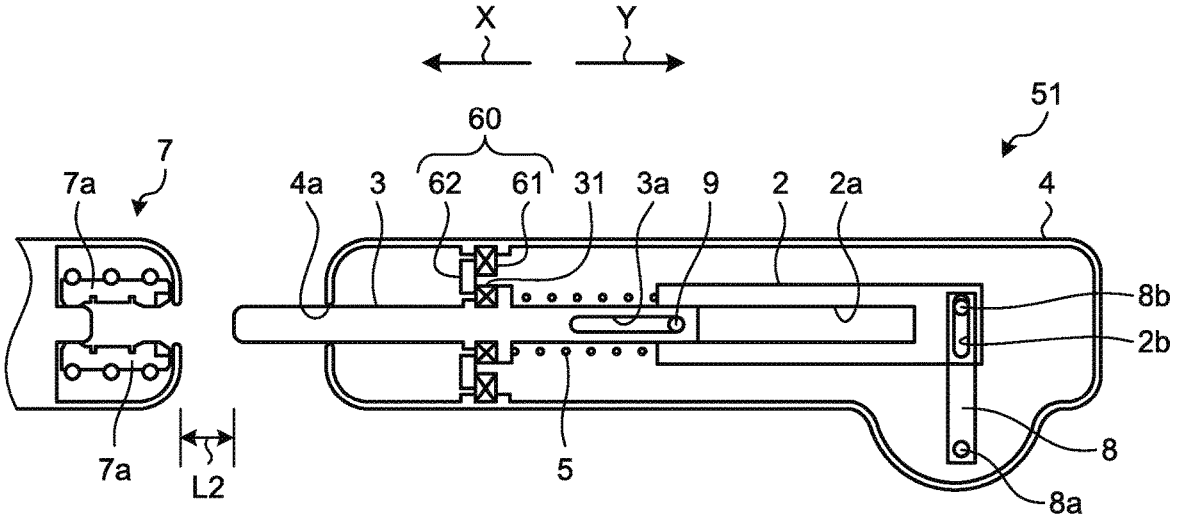
FIG. 8 is a cross-sectional view explaining closing operation in the switchgear according to the second embodiment.
Figure 9:
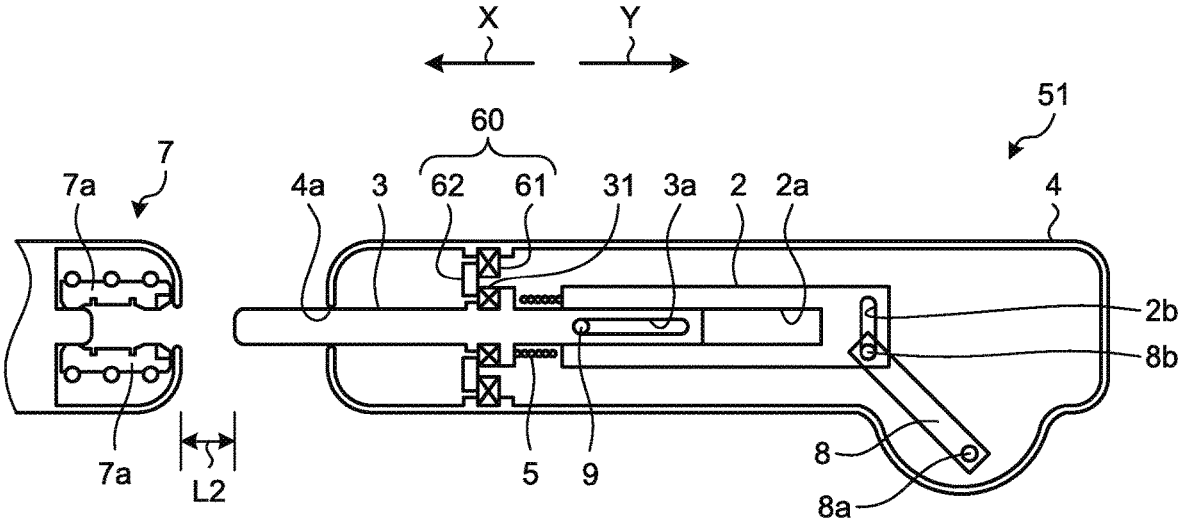
FIG. 9 is a cross-sectional view explaining the closing operation in the switchgear according to the second embodiment.
Figure 10:
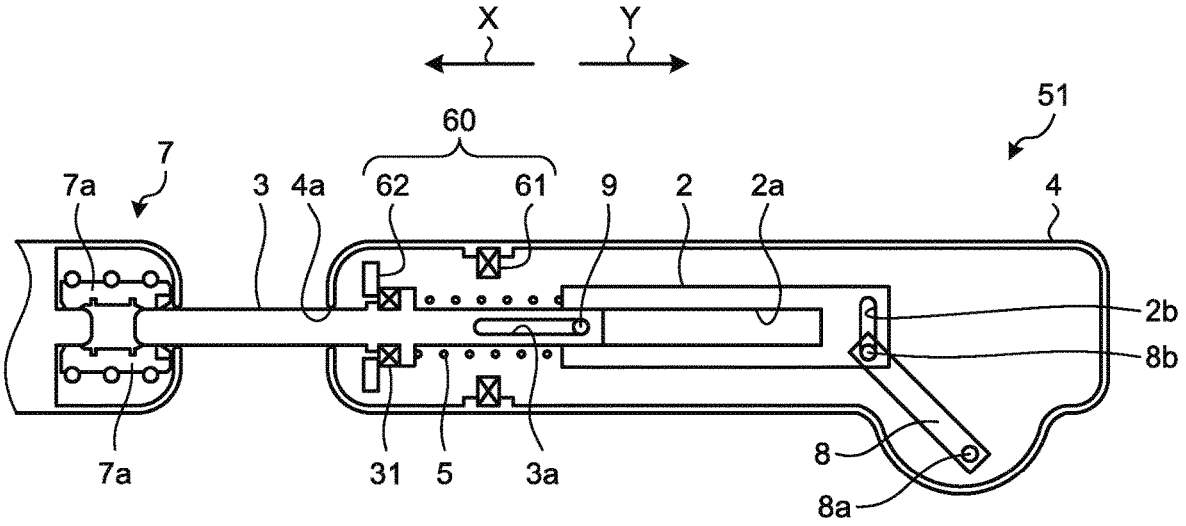
FIG. 10 is a cross-sectional view explaining the closing operation in the switchgear according to the second embodiment.
Figure 11:
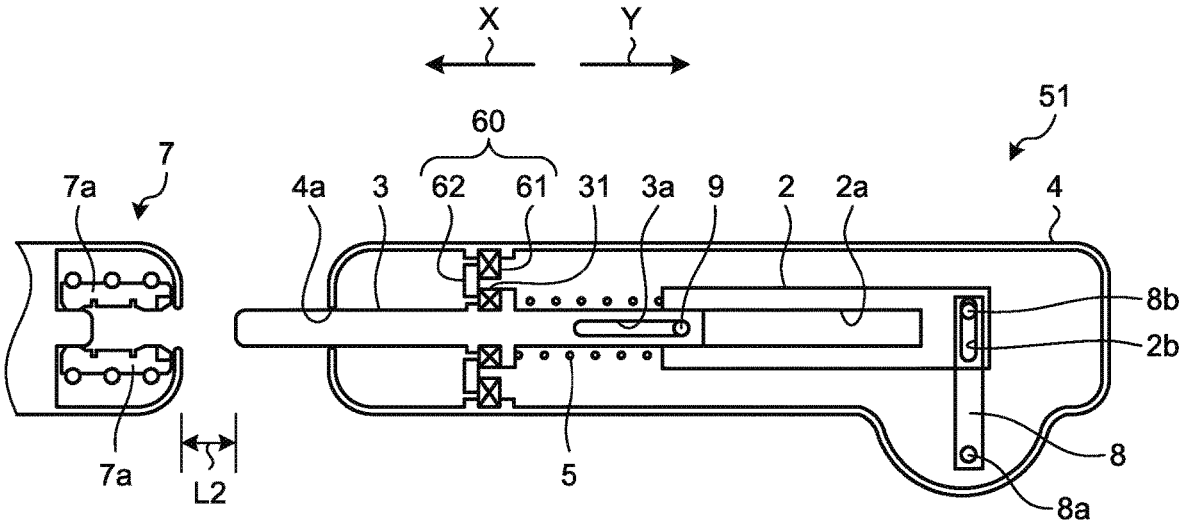
FIG. 11 is a cross-sectional view explaining opening operation in the switchgear according to the second embodiment.
Figure 12:
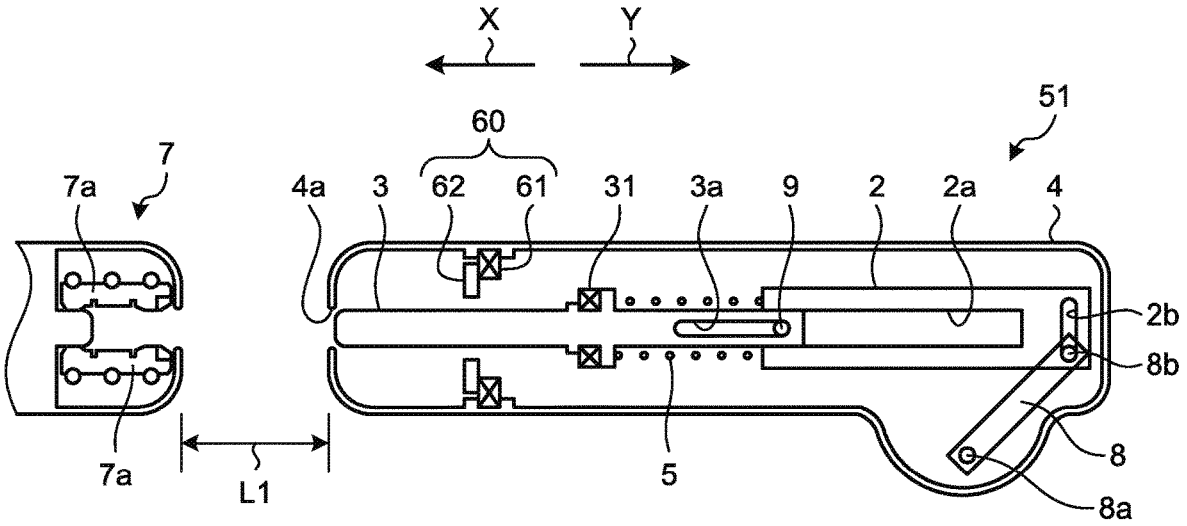
FIG. 12 is a cross-sectional view explaining the opening operation in the switchgear according to the second embodiment.

FIG. 7 is a cross-sectional view illustrating a schematic configuration of a switchgear according to a second embodiment of the present invention. FIGS. 8 to 10 are cross-sectional views explaining closing operation in the switchgear according to the second embodiment. FIGS. 11 and 12 are cross-sectional views explaining opening operation in the switchgear according to the second embodiment. Note that components similar to the components in the first embodiment described above will be represented by the same reference numerals, and detailed description thereof will not be repeated. In addition, in FIGS. 8 to 12, the operating device is not illustrated.

In a switchgear 51 according to the second embodiment, the latch part 60 includes a first magnet 61 fixed to the frame 4, and a metallic member 62 that is attracted by the first magnet 61 from side of the direction indicated by the arrow X when the movable part 2 and the movable contact 3 at the initial positions.

In addition, the movable contact 3 includes a second magnet 31 that comes in contact with part of the metallic member 62 avoiding the first magnet 61 from the side of the direction indicated by the arrow Y when the movable contact 3 has moved a predetermined distance in the direction indicated by the arrow X from the initial position.

In the switchgear 51 having the configuration as described above, as the movable part 2 and the movable contact 3 move a predetermined distance from the initial positions in the direction indicated by the arrow X during the closing operation, the second magnet 31 of the movable contact 3 comes into contact with the metallic member 62 as illustrated in FIG. 8. Because metallic member 62 is attracted by the first magnet 61, further movement of the movable contact 3 in the direction indicated by the arrow X is restricted. Specifically, a state in which the metallic member 62 is attracted by the first magnet 61 is the first state.

Subsequently, as the movable part 2 moves further in the direction indicated by the arrow X against the biasing force of the spring 5 in the state in which the movement of the movable contact 3 in the direction indicated by the arrow X is restricted, the spring 5 is compressed and the force thereof is accumulated as illustrated in FIG. 9. When the force accumulated in the first spring 5 exceeds the attractive force between the first magnet 61 and the metallic member 62, the state is switched to the second state in which the metallic member 62 is away from the first magnet 61 and the movement of the movable contact 3 in the direction indicated by the arrow X is permitted as illustrated in FIG. 10. As a result, the force accumulated in the spring 5 is released, and the movable contact 3 moves in the direction indicated by the arrow X at a speed higher than the moving speed of the movable part 2 before the release. The distal part of the movable contact 3 is then inserted between the contact points 7*a*, the movable contact 3 and the fixed contact 7 come into contact with each other, and the closing operation is thus completed. At this point, the movable part 2 and the movable contact 3 are at the closed positions. In addition, the metallic member 62 is attracted by the second magnet 31.

Next, opening operation in which the movable part 2 and the movable contact 3 move from the closed positions to the initial positions will be explained. As illustrated in FIG. 11, as the movable part 2 moves in the direction indicated by the arrow Y, the movable contact 3 is caught by the pin 9 and thus also moves in the direction indicated by the arrow Y. As a result, the movable contact 3 is separated from the fixed contact 7. In this process, the metallic member 62 is attracted by the second magnet 31 and moves together with the movable contact 3. In addition, the metallic member 62 comes in contact with the first magnet 61, and further movement in the direction indicated by the arrow Y is thus restricted.

As the movable part 2 and the movable contact 3 move further in the direction indicated by the arrow Y, the second magnet 31 is separated from the metallic member 62, and the movable part 2 and the movable contact 3 return to the initial positions as illustrated in FIG. 12. In this process, the metallic member 62 is attracted by the first magnet 61, and thus becomes the first state.

In the switchgear 51 according to the second embodiment as well, in a manner similar to the first embodiment, the movable part 2 and the movable contact 3 do not move at high speeds until the movement of the movable contact 3 becomes restricted and the force is accumulated in the spring 5. Subsequently, when the latch part 60 is switched to the second state, the movable contact 3 moves at high speeds.

This shortens the duration of an arc while reducing the size of the operating device and improve the maintenance efficiency.

The configurations presented in the embodiments above are examples of the present invention, and can be combined with other known technologies or can be partly omitted or modified without departing from the scope of the present invention.

REFERENCE SIGNS LIST

1 switchgear; 2 movable part; 2*a* hole; 2*b* groove; 3 movable contact; 3*a* groove; 3*b* projecting portion; 4 frame; 4*a* opening; 5 spring; 6 latch part; 7 fixed contact; 7*a* contact point; 8 lever; 8*a* shaft; 8*b* pin; 9 pin; 11 first pulley; 12 second pulley; 13 wire mechanism; 13*a* flexible jacket; 13*b* wire; 14 motor; 15 first base; 16 second base; 31 second magnet; 60 latch part; 61 first magnet; 62 metallic member.

The invention claimed is:

1. A switchgear comprising:

a movable part capable of reciprocating movement including movement in a first direction and movement in a second direction opposite to the first direction;

a movable contact coupled to the movable part on a side of the first direction, the movable contact being capable of reciprocating movement including movement in the first direction and movement in the second direction relative to the movable part;

a biasing member to bias the movable contact in the first direction relative to the movable part;

a latch part capable of switching between a first state in which movement of the movable contact in the first direction is restricted and a second state in which movement of the movable contact in the first direction is permitted; and a fixed contact provided on a side of the first direction with respect to the movable contact, wherein the movable part and the movable contact move in the first direction from initial positions at which the movable contact is away from the fixed contact to closed positions at which the movable contact is in contact with the fixed contact, and in a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the biasing member after the movement of the movable contact was restricted, the latch part is switched to the second state in which the movement of the movable contact in the first direction is permitted.

2. The switchgear according to claim 1, further comprising:

an accommodating part to accommodate the movable part and the movable contact therein, wherein the latch part includes a first magnet fixed to an inside of the accommodating part, and a metallic member, the metallic member being attracted by the first magnet from the side of the first direction when the movable part and the movable contact are at the initial positions, and the movable contact includes a second magnet to come into contact with a part of the metallic member avoiding the first magnet from the side of the second direction when the movement of the movable contact in the first direction is restricted by the latch part.

3. The switchgear according to claim 2, further comprising: a driver to move the movable part.

4. The switchgear according to claim 1, further comprising: a driver to move the movable part.

* * * * *